US012460909B2

(12) United States Patent
Harris et al.

(10) Patent No.: US 12,460,909 B2
(45) Date of Patent: Nov. 4, 2025

(54) POLYMER JACKED SOLID CORE PROJECTILE

(71) Applicant: The United States of America, as Represented by the Secretary of the Navy, Crane, IN (US)

(72) Inventors: Michael R. Harris, Dover, FL (US); David P. Armstrong, Bloomington, IN (US); Joseph T. Burkart, Bloomfield, IN (US); Lucius A Taylor, IV, Crane, IN (US)

( * ) Notice: Subject to any disclaimer, the term of this patent is extended or adjusted under 35 U.S.C. 154(b) by 0 days.

(21) Appl. No.: 18/591,395

(22) Filed: Feb. 29, 2024

(65) Prior Publication Data

US 2025/0277654 A1 Sep. 4, 2025

(51) Int. Cl.

| | |
|---|---|
| ***F42B 12/78*** | (2006.01) |
| ***F42B 14/02*** | (2006.01) |
| ***F42B 14/06*** | (2006.01) |

(52) U.S. Cl.

CPC ..... *F42B 14/02* (2013.01); *F42B 12/78* (2013.01); *F42B 14/06* (2013.01)

(58) Field of Classification Search

CPC ..... F42B 12/76; F42B 12/78; F42B 14/00; F42B 14/02; F42B 14/06

USPC ..... 102/515, 524, 526

See application file for complete search history.

(56) References Cited

U.S. PATENT DOCUMENTS

| | | | | | |
|---|---|---|---|---|---|
| 1,039,774 | A * | 10/1912 | Melander | F42B 5/24 | 102/511 |
| 3,164,092 | A | 1/1965 | Reed | | |
| 3,311,061 | A * | 3/1967 | Roehrdanz | F42B 14/064 | 102/523 |
| 3,910,194 | A * | 10/1975 | Dehm | F42B 14/02 | 102/527 |
| 4,040,359 | A | 8/1977 | Blajda | | |
| 4,239,006 | A * | 12/1980 | Kelson | F42B 14/04 | 102/522 |
| 4,328,750 | A * | 5/1982 | Oberg | C08K 3/30 | 427/195 |
| 4,574,703 | A | 3/1986 | Halverson | | |
| 4,754,708 | A * | 7/1988 | Garrett | F42B 14/02 | 102/527 |
| H794 | H * | 7/1990 | Telmo | 102/527 | |
| 6,186,071 | B1 | 2/2001 | Fry | | |
| 8,286,558 | B2 * | 10/2012 | Marx | F42B 14/02 | 102/527 |
| 11,821,714 | B2 * | 11/2023 | Folaron | F42B 10/46 | |

(Continued)

*Primary Examiner* — James S Bergin

(74) *Attorney, Agent, or Firm* — Christopher Feigenbutz; Naval Surface Warfare Center, Crane Division

(57) ABSTRACT

Provided is a polymer jacketed projectile with metal core. The projectile includes a metal bullet core and a monolithic polymer bullet jacket surrounding a portion of the bullet core. The jacket includes a series of radial driving bands cut into the jacket in a graduated configuration at increasing thicknesses. The graduation and increasing thickness of the driving bands allows gradual radial acceleration upon engraving of the rifling due to intentional radial deformation of the forward driving bands. Additionally, the bullet core) includes high-friction surfaces formed in a longitudinal direction or at a base of the bullet core. The modified surface increases friction between the bullet core and polymer, further decreasing radial slippage.

17 Claims, 5 Drawing Sheets

(56) References Cited

U.S. PATENT DOCUMENTS

| | | | | |
|---|---|---|---|---|
| 2001/0050020 | A1* | 12/2001 | Davis | F42B 12/745<br>102/506 |
| 2003/0101891 | A1* | 6/2003 | Amick | F42B 12/34<br>102/514 |
| 2007/0095241 | A1 | 5/2007 | Rice | |
| 2014/0318402 | A1* | 10/2014 | Carlson | F42B 30/02<br>102/524 |
| 2024/0271918 | A1* | 8/2024 | Beal | B22F 3/225 |

* cited by examiner

POLYMER JACKED SOLID CORE PROJECTILE

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200587US02) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to projectiles. More particularly, it pertains to a polymer jacketed projectile with metal core.

BACKGROUND

Prior to the late 1800's bullets were made of lead only, and were not jacketed with other metals. More recent traditional bullets, particularly ones in use since the late-1800s have been jacketed with copper, brass, mild steel, or other alloys, such as cupro-nickel. To reduce costs and conserve expensive metals, these projectiles incorporated only small amounts of copper-based metals in the form of driving bands, with the majority of the projectiles being constructed of lesser expensive materials such as iron or steel. A driving band is a band of soft metal surrounding the projectile. When the projectile is fired, the pressure of the propellant swages the driving band into the rifling of the barrel to form a seal that prevents the gases from firing to blow past the projectile. The driving bands also engage the rifling of the barrel in order to spin-stabilize the projectile.

Recently, with the rising cost of copper, lead, and other related metals, small arms projectiles have become increasingly expensive. As an example, military snipers and advanced marksmen often need to fire sniper-grade armor-piercing ammunition which can be twenty-thirty times more expensive than conventional ammunition. Furthermore, armor piercing ammunition causes severe damage to sound suppressors, muzzle brakes, and some flash-hiders, causing excessive equipment wear that prevents repeated use of these items for most sniper applications, as the damage prevents the required accuracy from being achieved. Furthermore, firearm barrels used in sniper applications and in conventional firearms are also subject to rapid degradation in accuracy due to barrel erosion and fouling when using traditional copper-based jackets.

Polymer is a material that has long been desired for use as a bullet jacket. Polymer has been used for driving bands and in discarding sabot rounds that are generally intended for armor piercing applications, where the sabot is lost immediately after muzzle exit of the projectile to avoid parasitic drag. The problem with utilizing polymer as a jacket relates to radial slippage of the bullet core, which is a common problem with hard-cored jacketed bullets and bullets with low melting point cores. This results in the jacket spinning down the rifling at a faster rate than the core. As the bullet leaves the barrel in flight, the effect of the core and jacket components spinning at a different rates causes dynamic effects that lead to inaccuracy if the entire projectile. This problem has been solved for lead-core bullets by bonding the lead core to the jacket, normally through a heat-bond soldering process during the manufacture of conventional bullets.

Radial slippage is even greater in armor-piercing bullets with solid metal cores, because the solder-bonding method between copper-alloy jackets and steel or tungsten cores is not practical using current industrial art. A solution in the current art is to envelop two jackets over the core, first an inner jacket of lead, or lead mixed with grit, and a second outer jacket of copper-based alloy. As can be appreciated, the issues associated with radial slippage are even greater with polymer due to the extreme dissimilarity of polymer and metal materials. From the above, it is clear that a novel solution for using polymer jackets that prevent damage to equipment and overcome the issues related to radial slippage is needed.

SUMMARY OF THE INVENTION

The present invention relates to a polymer jacketed projectile with metal core. The projectile includes a bullet core and a monolithic polymer bullet jacket surrounding a portion of the bullet core. The jacket includes a series of radial driving bands cut into the jacket in a graduated configuration at increasing thicknesses. The graduation and increasing thickness of the driving bands allows gradual radial acceleration upon engraving of the rifling due to intentional radial deformation of the forward driving bands. Additionally, the bullet core includes high-friction surfaces formed in a longitudinal direction or at a base of the bullet core. The modified surface increases friction between the bullet core and polymer, further decreasing radial slippage.

The inventive projectile replaces conventional metal-based jacketed designs and substitutes new high-temperature polymers. The polymer jackets help reduce life-cycle costs of military small arms by reducing the overall cost of ammunition. Additionally, because the polymer jacket is less abrasive than metal jackets, it reduces life-cycle costs of military small arms by reducing gun-barrel wear, and thus reduces barrel replacement costs of small arms. Furthermore, the polymer jacket provides a design that is more environmentally friendly, in that it allows for the use of tungsten or hardened steel alloys for the bullet core instead of lead. Finally, the lower density of the polymer jacket further helps to offset the high density armor piercing tungsten alloy core to allow for duplication of both the profile and weight of the standard projectile with the goal of providing the same ballistic flight characteristics/ballistic coefficient.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is a firearm projectile comprising: a bullet core; and a monolithic polymer bullet jacket surrounding a portion of the bullet core and comprising a series of radial driving bands cut into the jacket in a graduated configuration at increasing thicknesses.

In an illustrative embodiment, the firearm projectile further comprises a high-friction surfaces on the bullet core. In an illustrative embodiment, the high-friction surfaces are formed in a longitudinal direction of the bullet core. In an illustrative embodiment, the high-friction surfaces are formed at a base of the bullet core. In an illustrative embodiment, the firearm projectile further comprises a high-temperature adhesive to bond the bullet core to the polymer jacket.

In an illustrative embodiment, the monolithic polymer bullet jacket is constructed from nylon, radel, or a carbon containing polymer. In an illustrative embodiment, the firearm projectile further comprises an ablative material positioned behind the bullet core. to act as an ablative that will protect the bore of the firearm from erosion while also reducing gas temperature and/or consuming any oxidizing compounds. In an illustrative embodiment, the firearm projectile further comprises a wax or ablative positioned behind the bullet core. In an illustrative embodiment, the firearm projectile further comprises a wax or ablative positioned in a pocket in the rear of the projectile.

In an illustrative embodiment, the projectile further comprising a boat tail with an anti-slip feature to increase friction between the bullet core and the bullet jacket. In an illustrative embodiment, a forward most driving band makes contact with rifling in a barrel, swages and undergoes radial deformation and initiates radial acceleration or rotation of the projectile. In an illustrative embodiment, a second driving band makes contact with the rifling in the barrel, swages and undergoes radial deformation and causes radial acceleration to increase due to the additional thickness of the second driving band. In an illustrative embodiment, radial acceleration continues to increase as remaining driving bands make contact with the rifling.

Figure 1:
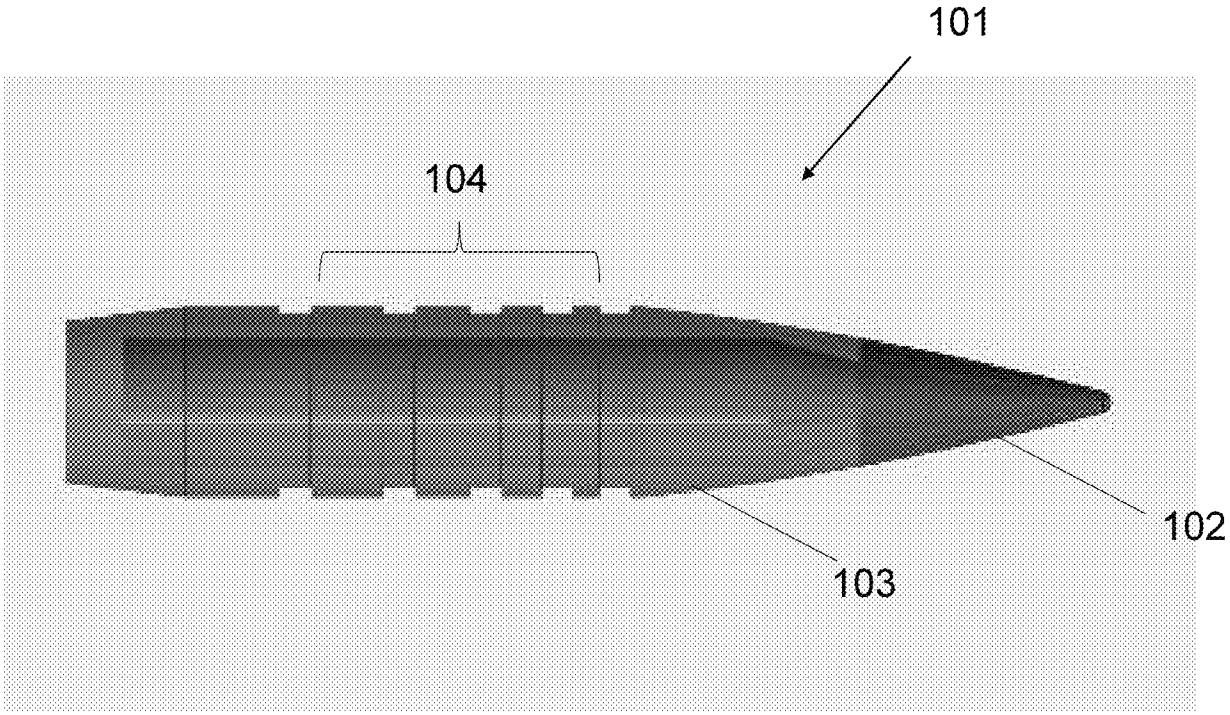
FIG. 1 shows a firearm projectile with a metal core bullet and a polymer jacket with a series of radial driving bands cut into the jacket in a graduated configuration at increasing thicknesses.
Figure 2:
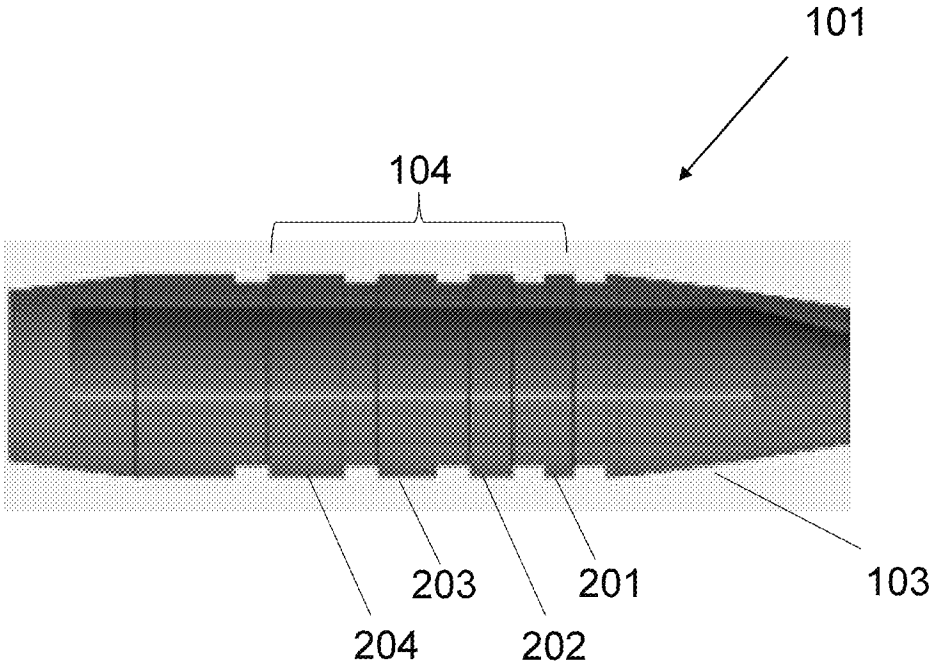
FIG. 2 shows a polymer jacket with a series of radial driving bands cut into the jacket in a graduated configuration at increasing thicknesses.

FIG. 1 shows a firearm projectile 101 with a metal core bullet 102 and a polymer jacket 103 with a series of radial driving bands 104 cut into the jacket 103 in a graduated configuration at increasing thicknesses. In an illustrative embodiment, the jacket 103 can have one or more radial driving bands 104 in a graduated configuration at increasing thicknesses from nose to tail. In an illustrative embodiment, shown in FIG. 1 are four radial driving bands 104 in a graduated configuration at increasing thicknesses. The driving bands 104 make contact with the barrel of the firearm when fired in order to create a seal between the projectile 101 and the barrel rifling to prevent gases from escaping. In an illustrative embodiment, the radial driving bands 104 prevent or mitigate radial slippage of the bullet core 102 in relation to the polymer jacket 103, which will be discussed in FIG. 2 shows a polymer jacket 103 with a series of radial driving bands 201-204 cut into the jacket in a graduated configuration at increasing thicknesses. In an illustrative embodiment, the increasing thickness of the radial driving bands 104 causes gradual radial acceleration upon engraving of the rifling due to intentional radial deformation of the forward driving band 201 when the projectile 101 is fired. As can be appreciated, when the projectile 101 is fired and moves from the chamber and into the barrel of a firearm, the pressure of the propellant swages (radially deforms) the driving bands 201-204 into the rifling of a barrel to form a seal that prevents the gases from firing to blow past the projectile 101. The forward most driving band 201 makes contact with the rifling first, and then the second 202, and so on. Contact between the rifling and the forward most driving band 201 initiates radial acceleration or rotation of the projectile 101. As the forward most driving band 201 contacts the rifling, the forward driving band 201 swages and undergoes radial deformation. As the second driving band 202 makes contact with the rifling, the intentional radial deformation continues and the radial acceleration increases due to the additional thickness of the second driving band 202. The process continues until all driving bands make contact with the rifling. In summary, the graduation and increasing thickness of the driving bands 201-204 allows for a more gradual radial acceleration upon engraving of the rifling due to intentional radial deformation of each successively thicker driving band than is accomplished with conventional driving bands.

Figure 3A:
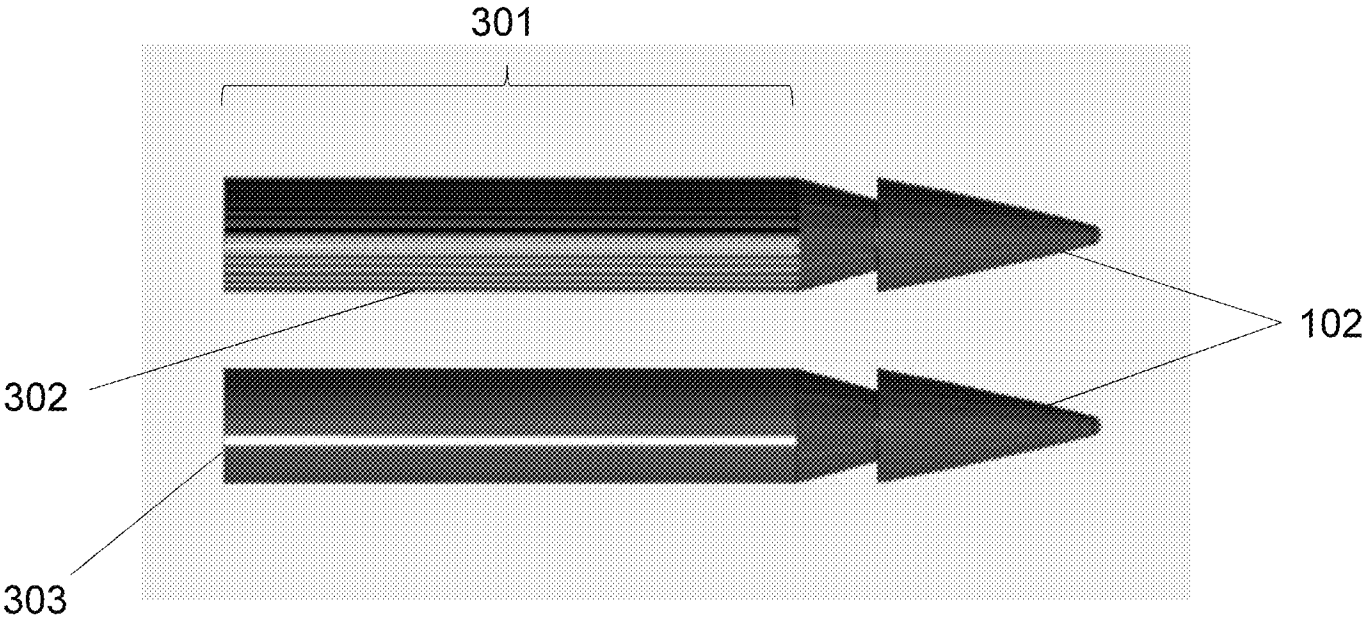
FIG. 3A shows the engraving of longitudinal striations onto the body of the bullet core.
Figure 3B:
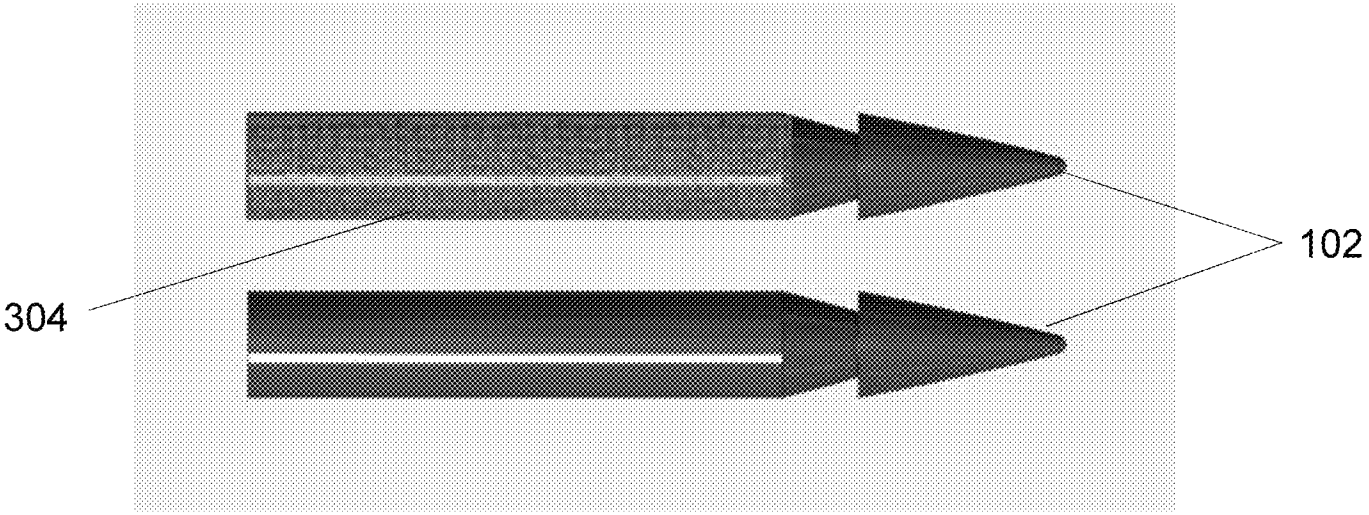
FIG. 3B shows the roughening of the bullet core surface.

FIG. 3A shows the engraving of longitudinal striations onto the body 301 of the bullet core 102, and FIG. 3B shows the roughening of the core 102. As described above, dissimilar materials used in the jacket and core of traditional projectiles results in the jacket spinning down the rifling at a faster rate than the core. As the bullet leaves the barrel in flight, the effect of the core and jacket components spinning at a different rates causes dynamic effects that lead to inaccuracy if the entire projectile. In an illustrative embodiment, the jacket and core are prevented from spinning at different rates by utilizing a bullet core 102 that includes high-friction surfaces formed in a longitudinal direction 302 or at a base 303 of the bullet core 102. In an illustrative embodiment, the modified surface increases friction between the bullet core 102 and the polymer jacket, which helps to decrease radial slippage therebetween. In an illustrative embodiment, the high-friction surfaces improve adhesion between the jacket and core 102. In an illustrative embodiment, the high-friction surfaces are created with longitudinal striations. In an illustrative embodiment, longitudinal striations can be formed into the bullet core 102 using industrial methods such as forming dies and laser etching. In an illustrative embodiment, roughening 304 of the bullet core 102 can be formed into the surface thereof using bead/grit-blasting, chemical (primer), or laser engraving methods.

Figures 4A, 4B, 4C:
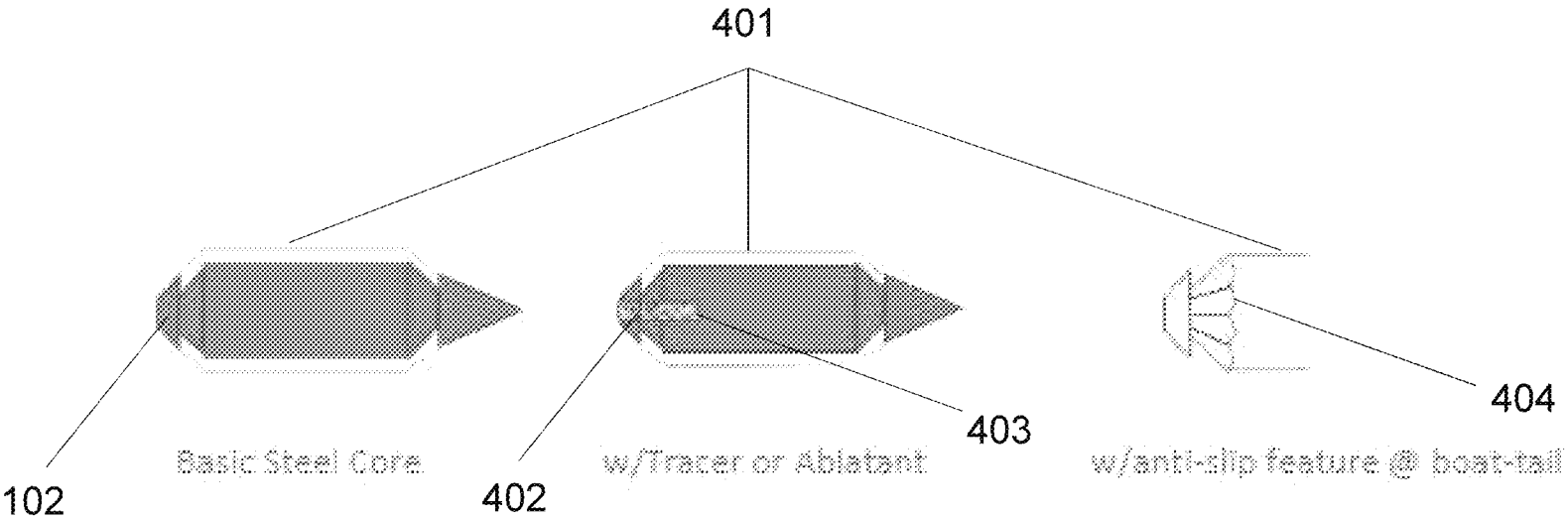
FIGS. 4A-C shows views of the bullet core.

FIGS. 4A-C shows views of the bullet core 401. In an illustrative embodiment, wax or another material can be added behind the projectile or in a pocket 402 in the rear of the bullet core 102 to act as an ablative 403 that will protect the bore of the firearm from erosion while also reducing gas temperature and/or consuming any oxidizing compounds. In an illustrative embodiment, the ablatant 403 in the pocket 402 provides an in-bore cooling affect. In an illustrative embodiment, the rear pocket 402 of the bullet core 102 can include a tracer compound. In an illustrative embodiment, the bullet core 102 can include a boat tail with an anti-slip feature 404 to further increase friction between the bullet core 102 and jacket, as described above.

The proper selection of the base polymer for molding the polymer jacket is crucial to ensuring that the projectile behaves similarly to conventional projectiles when fired and in flight. In an illustrative embodiment, the polymer needs to be stronger and less brittle than the discarding type sabots which need to break away at muzzle exit or open up due to rotational forces and drag. In an illustrative embodiment, the fill additions, such as carbon or glass fiber can be included for enhanced strength and HBN powder (Hexagonal Boron Nitride) can be used for improved thermal conductivity and lubricity while the projectile is moving down the bore. In an illustrative embodiment, the polymer must also be fully compatible with long term explosion for standard propellants. In an illustrative embodiment, the polymer needs to survive momentarily in the bore while exposed to high temperature gases as well. In an illustrative embodiment, the polymer shell is constructed from nylon, Radel, a carbon containing polymer, and the like. In an illustrative embodiment, the steel core is configured with as much mass as possible without the use of lead or other heavy metals, and the polymer jacket thickness is just enough to provide for proper engraving and to be retained or bonded to the core as necessary.

In an illustrative embodiment, the advantages of the inventive projectile described herein are reduction in costs due to the use of cheaper alternative materials, and the positive effect on small arms barrel wear rates. In an illustrative embodiment, another advantage of the inventive projectile is the avoidance of lead in the bullet design, which reduces the environmental damage caused by lead smelting and manufacturing, as well as keeping the impact areas of firing ranges free of lead.

In an illustrative embodiment, the inventive projectile includes multiple embodiments. In an illustrative embodiment, the inventive projectile comprises a tungsten hard alloy bullet core. In an illustrative embodiment, the inventive projectile comprises a lower-cost version using a hardened steel core. In an illustrative embodiment, the inventive projectile utilizes a core that ignites on impact due to a thermite type reaction that can be used for incendiary purposes (such as Ta—WO3).

In an illustrative embodiment, the core is constructed from steel, copper, or a similar alloy. In an illustrative embodiment, the projectile can be designed as a small arms projectile for use in a pistol, carbine, or rifle. In an illustrative embodiment, projectile can be designed for use as a .223 caliber projectile, a .308 caliber projectile, a .338, caliber projectile, a 6.5 caliber projectile, a 6.8 caliber projectile, or the like. In an illustrative embodiment, projectile can be designed for use as a 9 mm projectile, a .40 caliber projectile, a .45 caliber projectile, a .50 caliber projectile, or the like.

In an illustrative embodiment, chamber pressure is maintained with the use of crimping or round sealant.

Although the invention has been described in detail with reference to certain preferred embodiments, variations and modifications exist within the spirit and scope of the invention as described and defined in the following claims.

The invention claimed is:

1. A firearm projectile comprising:

a bullet core comprising a high-friction surface formed from nose to tail in a longitudinal direction or at a base of said bullet core; and a monolithic polymer bullet jacket surrounding a portion of said bullet core and comprising a series of radial driving bands cut into said jacket in a graduated configuration at progressively increasing width from nose to tail.

2. The firearm projectile of claim 1, further comprising a high-temperature adhesive to bond said bullet core to said polymer jacket.

3. The firearm projectile of claim 1, wherein said monolithic polymer bullet jacket is constructed from nylon, radel, or a carbon containing polymer.

4. The firearm projectile of claim 1, further comprising an ablative material positioned behind said bullet core to act as an ablative that will protect the bore of the firearm from erosion while also reducing gas temperature and/or consuming any oxidizing compounds.

5. The firearm projectile of claim 1, further comprising a wax or ablative positioned behind said bullet core.

6. The firearm projectile of claim 1, further comprising a wax or ablative positioned in a pocket in the rear of the projectile.

7. The firearm projectile of claim 1, further comprising a boat tail with an anti-slip feature to increase friction between said bullet core and said bullet jacket.

8. The firearm projectile of claim 1, wherein a forward most driving band makes contact with rifling in a barrel, swages and undergoes radial deformation and initiates radial acceleration or rotation of the projectile.

9. The firearm projectile of claim 8, wherein a second driving band makes contact with said rifling in said barrel, swages and undergoes radial deformation and causes radial acceleration to increase due to the additional thickness of said second driving band.

10. The firearm projectile of claim 9, wherein radial acceleration continues to increase as remaining driving bands make contact with said rifling.

11. A firearm projectile comprising:

a bullet core comprising a high-friction surface formed from nose to tail in a longitudinal direction or at a base of said bullet core; and a monolithic polymer bullet jacket surrounding a portion of said bullet core and comprising a series of radial driving bands cut into said jacket in a graduated configuration at progressively increasing width from nose to tail;

wherein a forward most driving band makes contact with rifling in a barrel, swages and undergoes radial deformation and initiates radial acceleration or rotation of the projectile;

wherein a second driving band makes contact with said rifling in said barrel, swages and undergoes radial deformation and causes radial acceleration to increase due to the additional thickness of said second driving band;

wherein radial acceleration continues to increase as remaining driving bands make contact with said rifling.

12. The firearm projectile of claim 11, further comprising a high-temperature adhesive to bond said bullet core to said polymer jacket.

13. The firearm projectile of claim 11, wherein said monolithic polymer bullet jacket is constructed from nylon, radel, or a carbon containing polymer.

14. The firearm projectile of claim 11, further comprising an ablative material positioned behind said bullet core to act as an ablative that will protect the bore of the firearm from erosion while also reducing gas temperature and/or consuming any oxidizing compounds.

15. The firearm projectile of claim 11, further comprising a wax or ablative positioned behind said bullet core.

16. The firearm projectile of claim 11, further comprising a wax or ablative positioned in a pocket in the rear of the projectile.

17. The firearm projectile of claim 11, further comprising a boat tail with an anti-slip feature to increase friction between said bullet core and said bullet jacket.

* * * * *